United States Patent [19]

Fort et al.

[11] 3,946,799

[45] Mar. 30, 1976

[54] MACHINE FOR CENTRIFUGALLY CASTING IRON PIPES

[75] Inventors: Pierre Henri Marie Fort, Nancy; Michel Pierrel, Pont-a-Mousson,, France

[73] Assignee: Pont-a-Mousson S.A., Nancy, France

[22] Filed: Apr. 1, 1975

[21] Appl. No.: 563,989

[30] Foreign Application Priority Data

Apr. 3, 1974 France ..... 74.11792

[52] U.S. Cl. ..... 164/286; 164/292; 164/298

[51] Int. Cl.[2] ..... B22D 13/02

[58] Field of Search ..... 164/114, 115, 117, 286, 164/292, 298, 287, 299–301

[56] References Cited

UNITED STATES PATENTS 2,030,105 2/1936 Eurich et al. ..... 164/286

2,671,260 3/1954 Jessen et al. ..... 164/114 X

FOREIGN PATENTS OR APPLICATIONS 680,520 5/1930 France

*Primary Examiner*—Ronald J. Shore
*Assistant Examiner*—Gus T. Hampilos
*Attorney, Agent, or Firm*—Sughrue, Rothwell, Mion, Zinn & Macpeak

[57] ABSTRACT

Maintaining devices maintain the rotary casting mould. Each device comprises a set of coplanar rollers arranged around a region of the mould. Each set comprises two lower support rollers and an upper pressing roller carried by a pivotal arm. Each pressing roller is a driving roller and each roller has a diameter at least equal to the diameter of the mould and a length at least equal to the diameter of the roller.

11 Claims, 5 Drawing Figures

MACHINE FOR CENTRIFUGALLY CASTING IRON PIPES

The present invention relates to machines for centrifugally casting iron pipes about a roughly horizontal axis. It more particularly concerns machines of the type in which a casting mould is maintained by maintaining devices which comprise sets of rollers, each set comprising at least three rollers which are coplanar and arranged around a region of the mould, namely two lower supporting rollers and an upper pressing roller which is carried by a pivotal arm.

Machines of this type are known in particular from French Pat. No. 680,520.

This patent discloses a machine in which the rollers are of small diameter and short length, the upper roller being applied against the upper generatrix of the mould during each centrifugal casting operation. The mould is driven in rotation through a rotary plate fixed by bolts to an end flange carried by the mould.

This known machine is not fully satisfactory for the following reasons: during casting, the mould is subjected to thermic shocks and is consequently liable to undergo deformations, in particular in deflection. This is particularly noticeable when pipes of relatively small diameters are cast, for example of the order to 150 to 200 mm diameter or less for a length of several meters. In this case, the mould, which has great length with respect to a small diameter, has a low moment of inertia and lacks stiffness. In the machine disclosed in the aforementioned patent, such a mould is frequently liable to deform to such an extent that it becomes impossible to manufacture a suitable pipe and extract it from the mould or even to introduce inside the mould a rectilinear pouring channel.

An object of the present invention is to provide a centrifugal casting machine whereby it is possible to rotate a mould, even of small diameter, while avoiding, or at least sufficiently delaying, the deformations of the mould.

According to the invention, there is provided a machine of the aforementioned type wherein the pressing roller of each set of rollers is a driving roller and the rollers of each set have a diameter at least equal to the diameter of the mould and an axial length at least equal to the diameter of the rollers.

With such an arrangement, the mould is very well supported and has no tendency to deviate from its axis during its rotation and is unhindered as to radial expansions and contractions.

Further features and advantages of the invention will be apparent from the ensuing description given by way of example with reference to the accompanying drawings, in which.

In the illustrated embodiment, the invention is applied to an installation for centrifugally casting iron pipes which have a socket and a small diameter.

The installation comprises in the known manner: machine A movable in translation along roughly horizontal rails B, for example under the action of a driving jack (not shown) disposed under the machine.

The machine is movable rearwardly toward a pouring spout C which is extended by a pouring channel D whose length corresponds to the length of the machine so as to introduce this channel in a casting mould 1 disposed within the machine A.

At the opposite end to the spout C and in the extension of the runway constituted by the rails B, there is disposed a second runway F along which is movable a carriage which carries a pipe extractor (not shown) and is driven by an endless chain E. Two pivotable supports G are adapted to support each pipe which has just been stripped from the mould.

The machine A is surrounded by a case 2 provided at its longitudinal ends with two circular apertures 3 having a common axis X—X. The aperture located adjacent the pipe extractor can receive before each casting a pivotable breech 4 carrying a core for forming the inner surface of the socket of the pipes. The axis X—X is parallel to the rails B but is laterally offset with respect to the plane of symmetry P—P of the case.

A control desk H for controlling the machine disposed near to the end of the rails B adjacent the extractor completes the installation.

Figure 1:
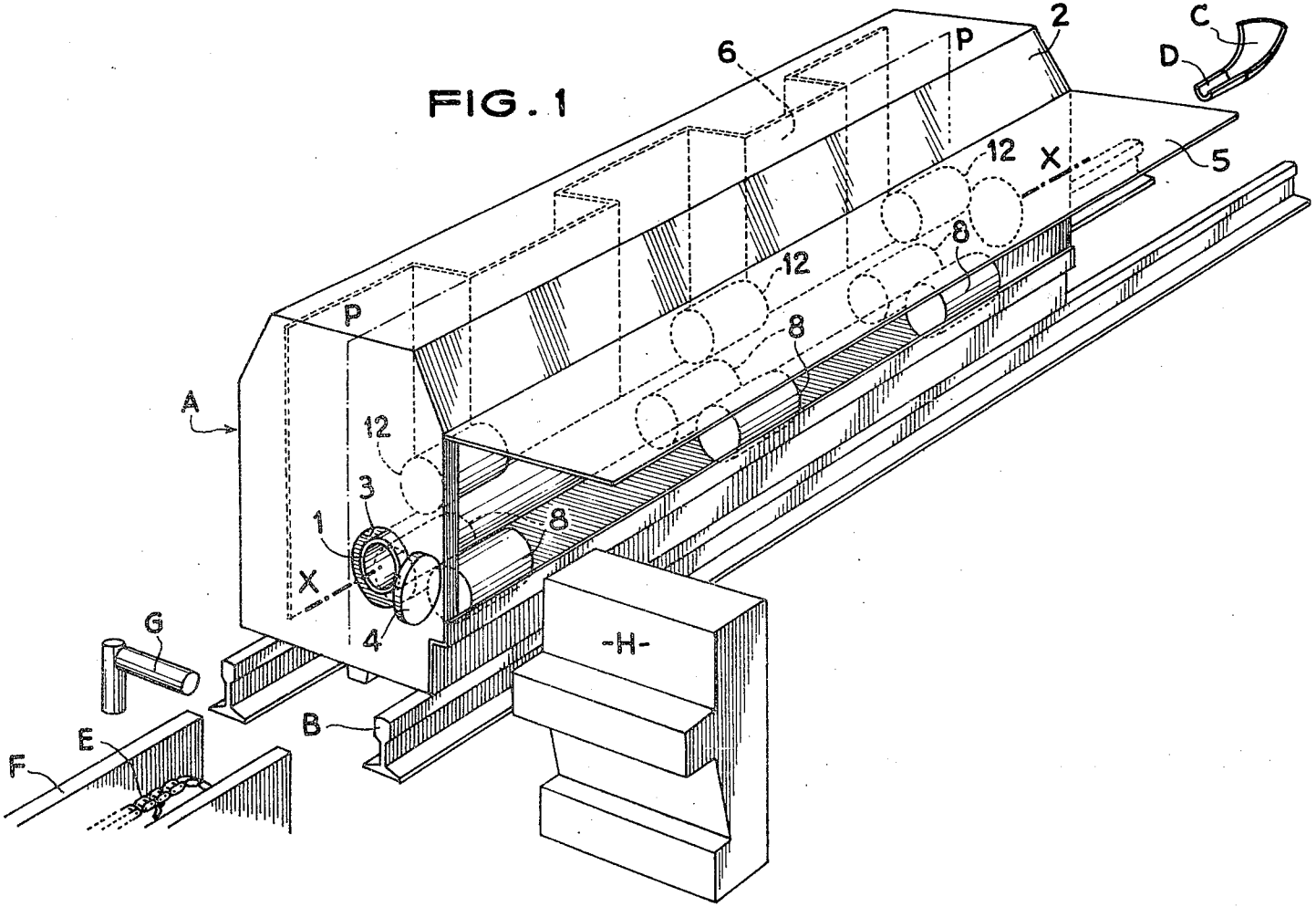
FIG. 1 is a diagrammatic partial perspective view of a centrifugal casting installation comprising a machine according to the invention.
Figures 2, 3, 4, 5:
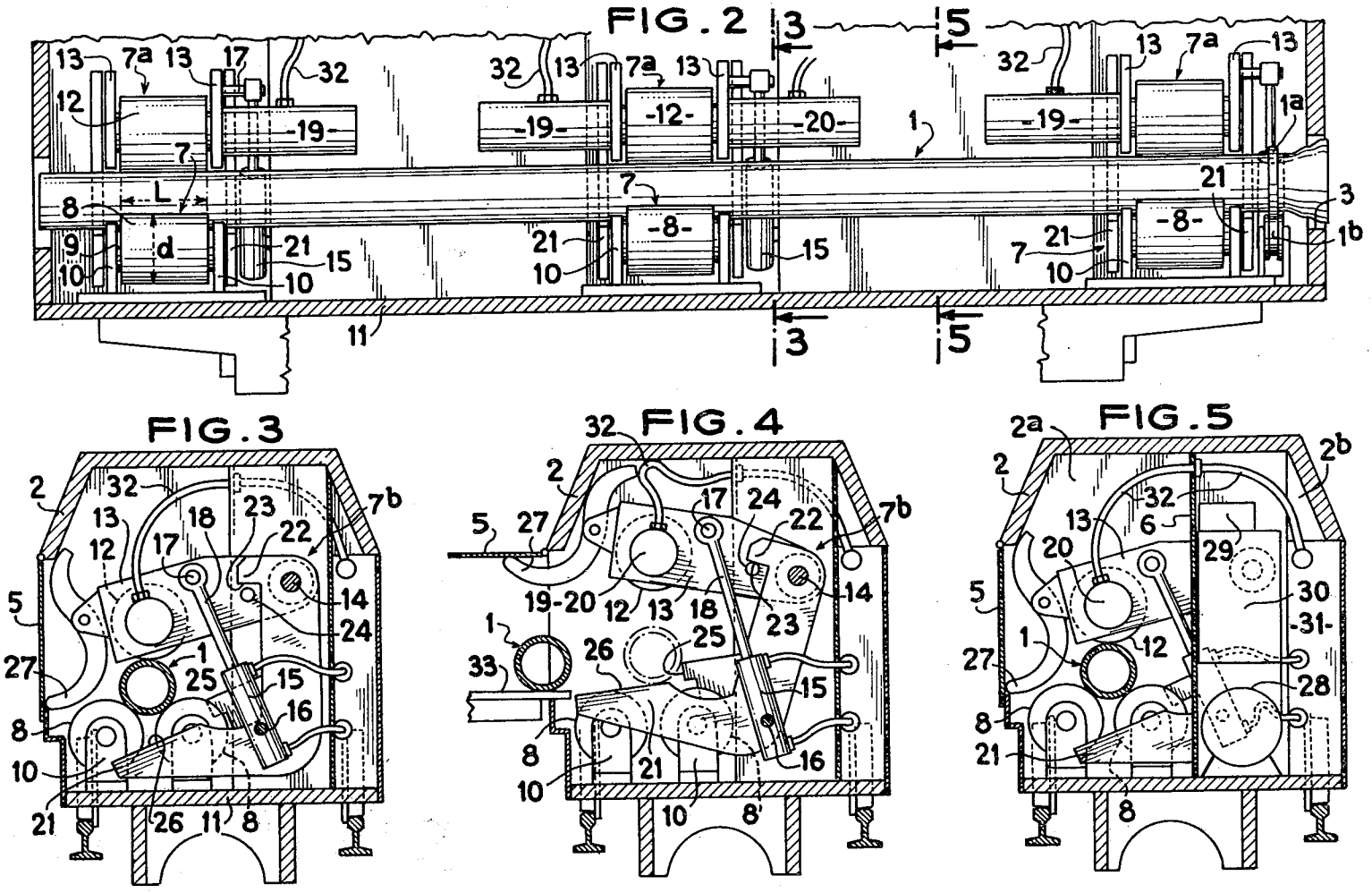
FIG. 2 is a diagrammatic longitudinal sectional view in a vertical plane containing the axis of the mould of this machine.
FIG. 3 is a sectional view taken on line 3—3 of FIG. 2.
FIG. 4 is a view similar to FIG. 3 showing the discharge or the introduction of the mould into the machine.
FIG. 5 is a sectional view taken on line 5—5 of FIG. 2.

The case 2 of the machine A has the general shape of a prism whose generatrices are parallel to the rails B. Adjacent the control desk H the case has throughout its length a lateral panel 5 which is pivotally mounted along its upper edge and which, when pivoted upwardly, uncovers a rectangular-shaped opening giving access to the inside of the case. An inner partition wall 6 which will be described hereinafter divides in a fluid-tight manner the interior of the case 2 into two chambers $2^a$ and $2^b$ (FIG. 5).

The chamber $2^a$, of larger volume, located adjacent the partition wall 6 into which the end aperture 3 of the case opens, contains three devices 7 adapted to maintain the mould 1 when it is driven in rotation and is being handled. A device 7 is provided near to each aperture 3 and midway along the length of the case. Each device 7 comprises a set $7^a$ of three rollers and a pivotal unit $7^b$.

Each set $7^a$ comprises two lower rollers 8 which are freely rotatable on fixed shafts 9 parallel to the rails B and located at the same level and an upper roller 12. These shafts 9 are carried by support members 10 fixed to the lower wall 11 of the case 2.

The upper roller 12 of each set $7^a$ is rotatably mounted between ends of two branches of a pivotal arm 13. This arm 13 is movable in the plane transverse to the lower rollers 8 by pivoting about a fixed horizontal pin 14 which extends through the other ends of the two branches of the arm 13.

The movements of the arm 13 are controlled by a hydraulic jack 15 operating between a fixed point 16 to which the body of the jack is pivoted and a point 17 of the arm 13 to which the end of the piston rod 18 of the jack is pivoted.

Each arm 13 also carries laterally a hydraulic motor 19 for directly driving the corresponding roller 12 in rotation.

Each unit $7^b$ comprises, in addition to the arm 13, an L-shaped lever 21 which is pivoted at one end to the same horizontal pin 14 as the associated upper arm 13.

The pivoted end of the lever 21 has a projecting portion 22 which extends toward the rollers and defines a lower shoulder 23 against which is capable of abutting a pin 24 carried laterally by the arm 13. The other end, or free end, of the L-shaped lever 21 is provided with a projecting portion 25 and an inclined ramp 26 the purpose of which will be explained hereinafter. It will be understood that the levers 21 are constituted by two identical parallel branches located on each side of the associated rollers.

The three devices 7 are on the whole identical but the intermediate device also carries a tachometric dynamo 20 driven by the upper roller 12, this dynamo being fixed to the pivotal arm 13 in facing relation to the electric motor 19.

The casting mould 1 is disposed on the lower rollers 8 and when the jacks 15 are in the withdrawn position, the upper rollers 12 bear downwardly against the upper generatrix of this mould.

In this position, the lever 21, under the effect of its own weight, takes up the position shown in FIG. 3 in which the end ramp 26 is located completely below the level of the upper generatrices of the lower rollers 8 and inclined outwardly and in which the pin 24 of the upper arms 13 is not in contact with the shoulder 23 of the lever 21.

In this position also, the mould 1 occupies the entire length of the case between the two end apertures 3 of the latter and its axis X—X is consequently offset with respect to the vertical plane of symmetry P of the case 2 in the direction of the lateral opening which the pivotal panel 5 closes under the effect of its own weight.

The axial positioning of the mould is ensured by a single flange $1^a$ carried by the end of the mould adjacent the pipe socket and guided by a grooved roller $1^b$.

The mould 1 is of small diameter with respect to its length. For example, it may have a diameter of between 60 mm and 200 mm for a length of 4 to 6 meters. The rollers 8 and 12 are all identical and they have a diameter at least equal to, and preferably greater than, that of the mould of the largest diameter intended to be employed in the machine and an axial length L at least equal to, and preferably greater than, their own diameter.

The end of the arms 13 which carries the upper rollers 12 is also provided with a pivoted hook 27 having a generally S shape (not shown in FIG. 2) the function of which will be explained hereinafter.

The devices 7 occupy in the transverse direction the major part of the width of the case 2 as can be seen in FIGS. 2 and 4. The partition wall 6 dividing the interior of the case has in plan the shape of a zig-zag line extending behind each device 7 and deeply penetrating between any two of the devices toward the interior of the case, that is to say toward the mould, roughly to the median plane P of the case. Almost the whole of the available space inside the case is thus used for housing all the accessory means and control means of the machine which are known per se and are necessary for the operation of the installation.

Thus there are in particular housed in compartments of the chamber **2*b* (FIG. 5) a hydraulic unit 28 for furnishing oil under pressure to the various hydraulic means, a unit 29 controlling the translation of the machine A along the rail B, the unit being for example a slide distributor valve connected to the jack effecting the movement of translation, a unit controlling the rotation of the mould 30 and a pipe box 31 extending throughout the length of the outer lateral wall of the chamber 2*b* and containing all the piping for the distribution of the fluid furnished by the hydraulic unit 28**.

FIGS. 2 – 5 show a flexible pipe or hose 32 for supplying fluid for driving a hydraulic motor 19 which drives an upper roller 12 in rotation. All the pipes, such as the pipe 32, extend in a fluidtight manner through the partition wall 6. The chamber **2*b* of course also contains all the means necessary for the synchronization of the operation of the three devices 7**.

The machine just described operates in the following manner:

When it is desired to dispose the mould 1 inside the machine, the jacks 15 are extended (FIG. 4). The upper arms 13 therefore pivot rearwardly about their fixed pivot pin 14. In the course of this pivoting movement the pin 24 abuts the shoulder 23 of the L-shaped levers 21 and the travel of the jacks 15 is arranged in such manner that, when they are in their completely extended position, the levers 21 have effected about the same fixed pins **14*a* pivoting movement under the action of the pins 24 of such extent that the ramps 26 of the levers 21 are put into facing relation to the lower edge of the lateral opening of the case at a level higher than that of the upper generatrices of the lower rollers 8 and slightly inclined outwardly. Simultaneously, the levers 27 carried by the upper arms 13 cooperate by their outer faces with the upper edge of this opening which causes them to pivot and amplify the movement of the arms 13. The lower end of the levers 27 thus raises the panel 5 to a horizontal position. The rails 33 are then moved transversely of the machine toward the latter until they bear against the lower edge of the lateral opening of the case and are in the extension of the ramp 26 and then the mould 1 is rolled along these rails 33 and the ramp 26 until it encounters the abutment 25 on the levers 21. The jacks 15 are then actuated to withdraw so as to pivot the upper arms 13 in the opposite direction until the upper rollers 12 press against the upper generatrix of the mould 1. The jacks 15 enable this pressure to be regulated. In the course of this movement of the arms 13, the pins 24 enable the levers 21 to pivot toward their position of rest and thereby deposit the mould on the lower rollers 8 before the mould has been pressed by the upper rollers 12. Thereafter, the pins 24 move away from the corresponding shoulders 23. The return movement of the upper arms 13 to the position shown in FIG. 3 also has for effect to shift the hooks 27 away from the pivotal panel 5 and this automatically closes the opening of the case. The motors 19 associated with each roller 12 are then started up. These motors then drive the mould 1 frictionnally and in a synchronized manner. The tachometric dynamo 20 is connected to a comparator which is part of the control unit 30** into which the desired speed of rotation is fed so as to correct at each instant any deviation between the reel speed and the desired speed. The latter may moreover be modified in the course of the casting, for example when passing from the region of the socket to the region of the pipe of constant diameter.

When it is desired to withdraw the mould 1 from the machine, for inspection or for replacing it by another mould, the operations which are the reverse of those just described for introducing the mould 1 are carried out and the panel 5 is automatically opened and the mould is automatically raised by the ramps 26 and laterally expelled under the action of the abutments 25 carried by the levers 21. The rails 33, which are shifted transversely to the position shown in FIG. 4, enable the mould to be moved away from the casing.

The essential advantages of the machine just described are the following:

Owing to the fact that the pressing rollers are also driving rollers and to the dimension of the rollers with respect to the dimension of the mould, it is observed that the latter is very well maintained in position and the inequalities in the thermic stresses liable to deform the mould (either bending it or rendering it oval) are absorbed by the rollers.

The upper rollers 12, being carried by pivotal arms 13, can move slightly away from or toward the lower rollers, the jacks 15 performing the function of shock absorbers. Consequently, the machine can be provided with moulds of different diameters without transformation.

Further, the radial and longitudinal expansions of the mould are not hindered by this machine.

The great length of the rollers enables the number of devices 7 to be limited. Consequently, room is made inside the case for providing fluidtight compartments which are well protected and easily accessible in which there may be disposed all the control means and the auxiliary means for the operation of the machine. Consequently, it is unnecessary to place all these means on the roof of the case and this affords great safety for the maintenance personnel and permits constructing the case from a non-rigid material, such as thin metal sheet or even a plastics material. This advantage is still further improved by the offsetting of the axis of the mould from the median plane of the case.

It will be observed that this machine permits an automatic and rapid withdrawal of the mould with no disassembly of the case nor any auxiliary lifting apparatus by means of an extremely simple pivotal device.

Owing to the ramp 14 and the abutment 15, the mould 1 can be positioned and handled in a precise and easy manner.

Having now described our invention what We claim as new and desire to secure by Letters Patent is:

1. A machine for centrifugally casting iron pipes comprising a rotary casting mould, a plurality of maintaining devices for maintaining the mould, each device comprising sets of rollers, each set comprising at least three rollers which are coplanar and arranged around a region of the mould, namely two lower support rollers and an upper pressing roller, a pivotal arm carrying the pressing roller, the pressing roller of each set of rollers being a driving roller and the rollers of each set having a diameter at least equal to the diameter of the mould in the corresponding region of the mould and an axial length at least equal to the diameter of the rollers.

2. A machine as claimed in claim 1, comprising a motor carried by each pivotal arm and directly drivingly connected to the corresponding pressing roller, and means for operating the motors in a synchronized manner.

3. A machine as claimed in claim 1, comprising a lever for laterally discharging the mould and combined with each pivotal arm so as to be actuated by the arm in the course of the movement of the arm for moving the pressing roller away from the mould.

4. A machine as claimed in claim 3, wherein the mould-discharging lever has an L-shape and has one end which is pivotally mounted and an opposite end provided with a ramp, the ramp having an upper surface which is laterally inclined and movable, in accordance with the position of the corresponding lever, between a level lower and a level higher than the level of the upper generatrices of the support rollers.

5. A machine as claimed in claim 4, wherein each mould-discharging lever has a projecting portion and a pin carried by the corresponding pivotal arm is capable of coming in contact in the course of the movement of the pivotal arm away from the mould in contact with the projecting portion for shifting the lever toward said higher level.

6. A machine as claimed in claim 3, wherein each pivotal arm and the associated mould-discharging lever are pivotally mounted on a common fixed pin.

7. A machine as claimed in claim 4, wherein each mould-discharging lever comprises a mould-ejecting abutment in the vicinity of the ramp.

8. A machine as claimed in claim 1, comprising a case defining a lateral opening for passage of the mould through the case laterally of the case, and a panel for selectively closing and opening the lateral opening and mounted to pivot about an axis parallel to the axis of the mould, the maintaining devices being disposed inside the case.

9. A machine as claimed in claim 8, comprising a pivotal lever pivotally mounted on an outer end portion of each pivotal arm, the case having a fixed wall, the second lever being cooperative with the fixed wall and with the panel for opening and closing the panel in the course of the movements of the pivotal arm.

10. A machine as claimed in claim 8, comprising inside the case a fluidtight partition wall extending behind the maintaining devices relative to said opening and penetrating, in the direction of the mould, between said maintaining devices so as to define at least one lateral compartment for housing control means for the machine.

11. A machine as claimed in claim 8, wherein the axis of the mould is laterally offset with respect to a longitudinal plane of symmetry of the casing.

* * * * *